US005731946A

United States Patent [19]

Kahr

[11] Patent Number: 5,731,946

[45] Date of Patent: Mar. 24, 1998

[54] PARALLEL CIRCUIT FOR DRIVING AN ELECTROMAGNETIC LOAD

[75] Inventor: Viktor Kahr, Stuttgart, Germany

[73] Assignee: Robert Bosch GmbH, Stuttgart, Germany

[21] Appl. No.: 571,836

[22] PCT Filed: Apr. 11, 1995

[86] PCT No.: PCT/DE95/00501

§ 371 Date: Dec. 26, 1995

§ 102(e) Date: Dec. 26, 1995

[87] PCT Pub. No.: WO95/29492

PCT Pub. Date: Nov. 2, 1995

[30] Foreign Application Priority Data

Apr. 27, 1994 [DE] Germany ..... 44 14 609.4

[51] Int. Cl.[6] ..... H01H 47/32

[52] U.S. Cl. ..... 361/154; 361/187; 361/190

[58] Field of Search ..... 361/154, 187, 361/189, 190

[56] References Cited

U.S. PATENT DOCUMENTS

| | | | |
|---|---|---|---|
| 4,345,296 | 8/1982 | Breitling | 361/154 |
| 4,360,855 | 11/1982 | Ohba | 361/154 |
| 4,706,619 | 11/1987 | Buchl | 123/90.11 |
| 4,716,359 | 12/1987 | Numata et al. | 323/349 |
| 4,885,658 | 12/1989 | Buchl | 361/154 |
| 5,029,040 | 7/1991 | Ito et al. | 361/187 |
| 5,214,561 | 5/1993 | Morita | 361/187 |
| 5,347,419 | 9/1994 | Caron et al. | 361/154 |
| 5,568,349 | 10/1996 | Kowalewski | 361/154 |
| 5,590,013 | 12/1996 | Harasawa | 361/187 |

FOREIGN PATENT DOCUMENTS

| | | | |
|---|---|---|---|
| 36 11 221 | 11/1986 | Germany | H01F 7/18 |
| 36 36 809 | 5/1987 | Germany | G05F 1/56 |
| 38 05 031 A1 | 8/1989 | Germany | H01F 7/18 |

*Primary Examiner*—Jeffrey A. Gaffin
*Assistant Examiner*—Thuy-Trang N. Huynh
*Attorney, Agent, or Firm*—Kenyon & Kenyon

[57] ABSTRACT

A device for driving a load, in particular an electromagnetic load. The device includes a current detector for detecting the current flowing through the load, a power transistor connected in series to the load, which is triggered in dependence upon the current flowing through the load, and a further transistor arranged in parallel to the power transistor. The device has the advantage of reducing the power dissipation in the power transistor.

7 Claims, 2 Drawing Sheets

PARALLEL CIRCUIT FOR DRIVING AN ELECTROMAGNETIC LOAD

FIELD OF THE INVENTION

The present invention relates to a device for driving a load, in particular an electromagnetic load.

BACKGROUND INFORMATION

German Published Patent Application No. 38 05 031 describes a device for driving a load, in particular an electromagnetic load. An actual-current measurement is used to measure the current flowing through the load and to adjust it to a setpoint value. In dependence upon the current flowing through the load, a switch connected in series to the load is triggered.

As switches, power transistors are preferably used. If the current is adjusted by means of an analog control loop, then very high power losses occur in the power transistor. The power consumption of transistors is essentially dependent upon the maximum permissible temperature and upon their thermal coupling to the surroundings. If the power loss exceeds the maximum power consumption of the transistor, then usually a transistor with a higher maximum power loss is used and/or the power loss is divided up among several transistors. These measures are often too expensive or do not suffice.

SUMMARY OF THE INVENTION

The present invention provides a device for driving a load, in particular an electromagnetic load, comprising means for detecting the current flowing through the load, a control means, such as a power transistor, connected in series to the load which is triggered in dependence upon the current flowing through the load, and a circuit component, such as a field-effect transistor, arranged parallel to the control means.

An object of the present invention is to reduce the power loss of the power transistor.

When working with the device according to the invention, it is possible to use power transistors having a considerably smaller maximum power consumption, thus less expensive transistors.

DETAILED DESCRIPTION

In the exemplary embodiment, the load is the coil of a solenoid valve which influences the metering of fuel into an internal combustion engine. By applying activation signals to this solenoid valve, the beginning of injection, the end of injection, and thus also the injected fuel quantity can be controlled. For this purpose, the solenoid valve must open and/or close at a defined instant. Furthermore, the solenoid valve must reach its new end position as quickly as possible after the driving signal is output.

Figure 1:
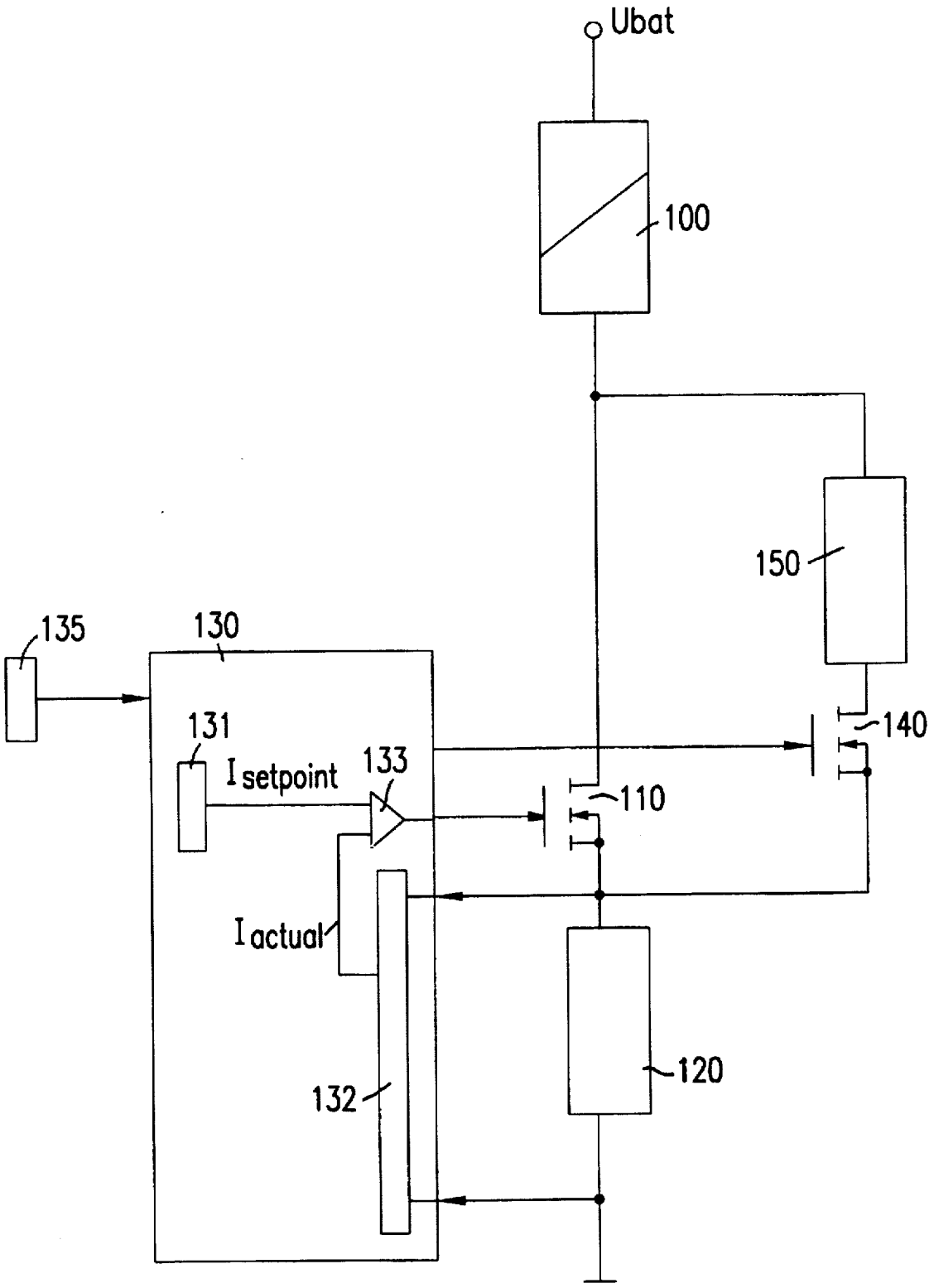
FIG. 1 schematically depicts the elements of a device in accordance with the present invention.

FIG. 1 schematically depicts the elements of an embodiment of a device according to the present invention. An electromagnetic load 100 is coupled at its first terminal to a battery voltage and at its second terminal to a control means 110.

The control means 110 is preferably a transistor, in particular, a field-effect transistor. Here, the second connection of the load is linked to the drain connection of the field-effect transistor 110. The source connection of the transistor 110 communicates with a current-measuring means 120 for detecting the current flowing through the load. The second connection of the current-measuring means 120 is connected to ground.

The configuration of these three elements is merely shown for illustrative purposes. It is equally possible to arrange these elements in a different sequence. Thus, for example, one could interchange the ground and the battery terminals.

The connection point between the second connection of the load 100 and the control means 110 is linked to the first connection of a resistor 150. The second connection of the resistor 150 is linked to a circuit component 140. As circuit component 140, preferably a transistor, in particular, a field-effect transistor is used. In this case, the second connection of the resistor 150 is linked to the drain connection of the transistor 140. The source connection of the transistor 140 is in contact with the connection point between the control means 110 and the current-measuring means 120.

A control unit 130 applies driving signals to the gate connection of the transistor 140 and to the gate connection of the transistor 110.

The current-measuring means 120 is preferably realized as a resistor. The two connections of the resistor 120 are sampled by the control unit 130. The two voltage values are supplied to a current-detecting means 132 which, on the basis of the voltage drop across the resistor 120, prepares an actual current value $I_{actual}$. This actual value $I_{actual}$ is fed as an actual value to a first input of a controller 133. A second input of the controller 133 communicates with a setpoint selection unit 131, which applies a setpoint value $I_{actual}$ to the second input. The output of the controller 133 applies an appropriate signal to the gate of the transistor 110.

To generate the driving signals, the control device 130 evaluates various output signals from sensors 135.

Figure 2:
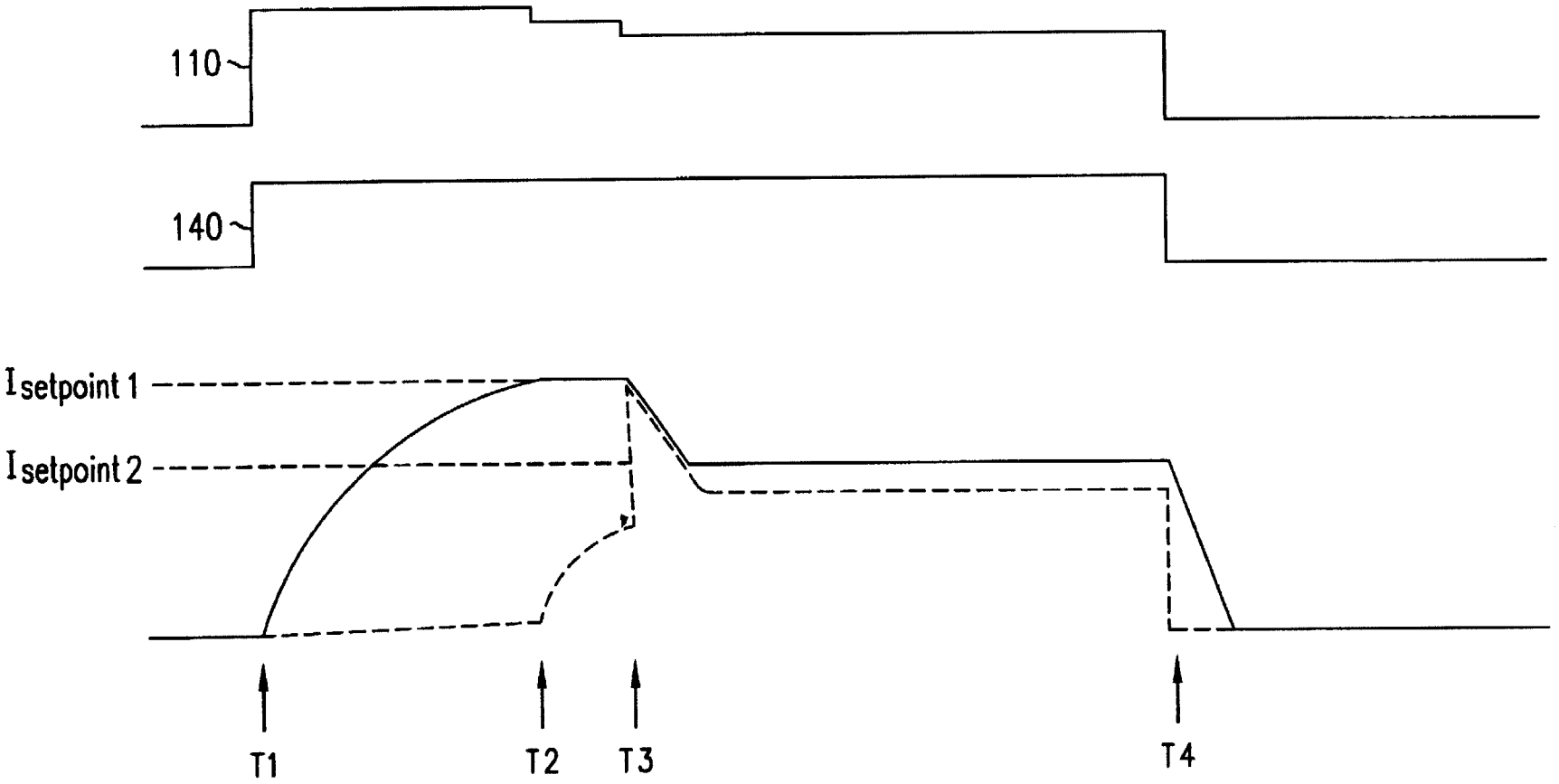
FIG. 2 shows various signals in the device of FIG. 1.

The method of functioning of this device is described in the following on the basis of FIG. 2. Plotted in the first line of the Figure is the driving signal for the control means 110, in the second line, the driving signal for the circuit component 140, and in the third line, the current through the circuit component 140 as a dotted line, and the entire current that flows through the solenoid valve 100, as a solid line.

At the beginning of activation at the instant T1, the circuit component 140 and the control means 110 are completely switched through. The current flowing through the solenoid valve rises up to the setpoint value for the inrush current $I_{setpoint1}$. The inrush current is reached at the instant T2. For as long as the control means 110 between the instants T1 and T2 is completely switched through, the resistance of the control means 110 is equal to or smaller than the resistance of the circuit component 140 and of the resistor 150. In this phase, the largest component of the current flows through the control means 110 and only a small component through the circuit component 140.

As of the instant T2, the driving of the control means 110 is reduced. This means the resistance of the control means 110 increases. As a result, the current flowing through the circuit component 140 rises.

As of the instant T3, the setpoint value for the current is lowered to its holding current level $I_{setpoint2}$. This means the driving for the control means 110 is reduced further. As a result, the resistance of the control means 110 and, thus, the current flowing through the circuit component 140 rise.

At the instant T4, the activation of the solenoid valve ends. This means, for example, the circuit component 140 is opened and the control means 110 is so driven that the current flowing through the control means 110 slowly returns to zero. The current flowing through the circuit component 140 drops off immediately.

The dimensional design of the resistor 150 is such that as of the instant T3, the largest current component flows through the circuit component 140 and the resistor 150. Merely a small current component flows via the control means 110. This is achieved in that in the period of time between T3 and T4, the branch comprised of the resistance means 150 and the circuit component 140 has a smaller resistance than the control means 110.

This means that the branch comprised of the resistance means 150 and the circuit component 140 also consumes the largest component of the power loss. After the setpoint value for the inrush current is reached, the control means is controlled back to the extent that the current flowing through the control means 110 corresponds at this point to the difference between the setpoint value $I_{setpoint}$ and the current flowing through the circuit component 140.

The circuit component 140 is completely switched through each time and works as a switch. The largest component of the current flows through the circuit component 140. The branch comprised of the resistor 150 and of the circuit component 140 also consumes the largest component of the power loss. The control means 110 works as an analog-current controller. The control means 110 absorbs the differential current between the setpoint value and the current that flows through the circuit component 140.

The essential part of the energy dissipation is converted in the resistor 150 and not in a transistor. In comparison to transistors, resistors can be rated at the same cost for substantially higher temperatures. With little outlay, one can achieve a good thermal coupling to the surroundings, i.e., to heat sinks. The driving of the output stages is simple in comparison to the costly additional circuitry required to divide up the power losses among several power transistors.

The power resistor 150 does not need to have narrow tolerances, since the control means 110 carries out a current control. Moreover, the resistor 150 can be installed externally to the control unit, for example in the vicinity of the load 100.

What is claimed is:

1. A device for driving an electromagnetic load, comprising:

current detector means for detecting a current flowing through the load;

control means connected in series with the load, the control means being activated to conduct in dependence upon the current flowing through the load; and a circuit component arranged parallel to the control means, thereby forming a parallel circuit arrangement, the parallel circuit arrangement being connected in series with the current detector means;

wherein the control means conducts a portion of the current flowing through the load when the circuit component is activated.

2. The device of claim 1, further comprising a resistor arranged in series to the circuit component.

3. The device of claim 2, wherein a resistance of the series combination of the resistor and the circuit component is smaller than a resistance of the control means.

4. The device of claim 1, wherein the control means is activated in dependence upon a difference between the current flowing through the load and a setpoint current.

5. The device of claim 1, wherein the circuit component operates as a switch.

6. The device of claim 1, wherein at the beginning of an activation for driving the load, the circuit component and the control means become fully conductive.

7. The device of claim 1, wherein each of the control means and the circuit component conducts a portion of the current flowing through the load when both the control means and the circuit component are activated.

* * * * *